United States Patent [19]

Latimer, Jr.

[11] 4,017,816

[45] Apr. 12, 1977

[54] FERRULE FUSE TERMINAL CLIP WITH PIVOTED REJECTOR

[75] Inventor: William R. Latimer, Jr., Bellefontaine, Ohio

[73] Assignee: I-T-E Imperial Corporation, Spring House, Pa.

[22] Filed: Dec. 29, 1975

[21] Appl. No.: 644,577

[52] U.S. Cl. ..... 337/227; 339/253 F; 339/258 F

[51] Int. Cl.[2] ..... H01H 85/14

[58] Field of Search ..... 337/227, 231, 233, 234, 337/236, 237; 339/253 F, 258 F, 259 F

[56] References Cited

UNITED STATES PATENTS

| | | | |
|---|---|---|---|
| 2,943,295 | 6/1960 | Stewart | 339/258 F |
| 3,198,913 | 8/1965 | Stanback | 339/258 F |
| 3,927,929 | 12/1975 | Puetz | 339/258 F |

*Primary Examiner*—George Harris
*Attorney, Agent, or Firm*—Ostrolenk, Faber, Gerb & Soffen

[57] ABSTRACT

A ferrule fuse terminal clip with a pivoted U-shaped rejector member extending between its complementary curved clip legs. The pivotable rejector member facilitates the insertion and removal of a low rated-current cartridge fuse having a grooved ferrule end terminal and prevents the insertion of a non-grooved ferrule terminal of a cartridge fuse having a higher rated current. The rejector member is easily installed in a conventional ferrule fuse terminal clip and cannot be removed therefrom utilizing common tools without rendering the fuse terminal clip unusable.

4 Claims, 3 Drawing Figures

FERRULE FUSE TERMINAL CLIP WITH PIVOTED REJECTOR

BACKGROUND OF THE INVENTION

The present invention relates to fuse protection means and more particularly to a novel ferrule fuse terminal clip having a pivoted rejector member to prevent insertion of a non-grooved ferrule end terminal of a fuse having an excessively high current rating.

Conventional high rated-current cartridge fuses are provided with an opposed pair of smooth cylindrical ferrule end terminals. Another class of ferrule-type cartridge fuse is manufactured with at least one ferrule end terminal having an annular groove formed into the surface of the cylindrical terminal to provide means for recognition of its relatively low current rating. A conventional ferrule fuse terminal clip will receive the ferrule end terminal of either fuse class and is acceptable for protecting a circuit designed to carry the highest current capable of flowing through a fuse of either type; the reduction in circuit current rating provided by the lower current rating of the grooved-type terminal fuse may be advantageously utilized to protect a load device capable of being damaged by the full flow of circuit-rated current.

It is desirable to provide a ferrule end terminal clip with means for accepting only a grooved ferrule end terminal of a fuse having a relatively low current rating, and to prevent installation of a non-grooved ferrule fuse to prevent passage of a current in excess of the circuit current rating and avoid formation of an overcurrent hazard therein.

BRIEF SUMMARY OF THE INVENTION

In accordance with the invention, a ferrule fuse terminal clip having a pair of opposed and complementary curved contact legs adapted to receive a ferrule fuse end terminal in the gap therebetween is provided with a U-shaped rejector member extending across the clip gap and positioned substantially transverse to the interior surface of each contact leg. The rejector member has a pivot arm outwardly extending from each free end of the U-shaped portion. Each pivot arm extends through one of an aligned pair of apertures in the fuse clip contact legs and is peened over adjacent to the exterior surface of each contact leg to prevent the removal of the rejector member. The rejector member extensions are adapted for rotation within their associated contact leg apertures to allow a pivoting movement of the U-shaped portion.

The U-shaped rejector member is positioned to enter the groove of a grooved-type ferrule end terminal to allow the terminal to be fully captured by the fuse clip, while preventing the insertion of a non-grooved ferrule end terminal to a sufficient depth within the gap between the contact legs to allow retention therein.

Accordingly, it is a primary object of the present invention to provide means for facilitating insertion of a grooved ferrule end terminal in a terminal clip while rejecting a non-grooved ferrule end terminal.

It is another object of the present invention to provide a ferrule fuse terminal clip with a rejector member capable of simple and rapid installation and manufacture at a low cost.

It is still another object of the present invention to provide a ferrule fuse terminal clip with a rejector member capable of pivoting motion to facilitate insertion and removal of a grooved ferrule fuse terminal therein.

It is a further object of the present invention to provide a rejector member incapable of being removed from its ferrule fuse terminal with commonly available tools without rendering that fuse terminal clip unusable.

These and other objects of the present invention will become apparent upon consideration of the following detailed description and the drawings.

DETAILED DESCRIPTION OF THE INVENTION

Figure 1:
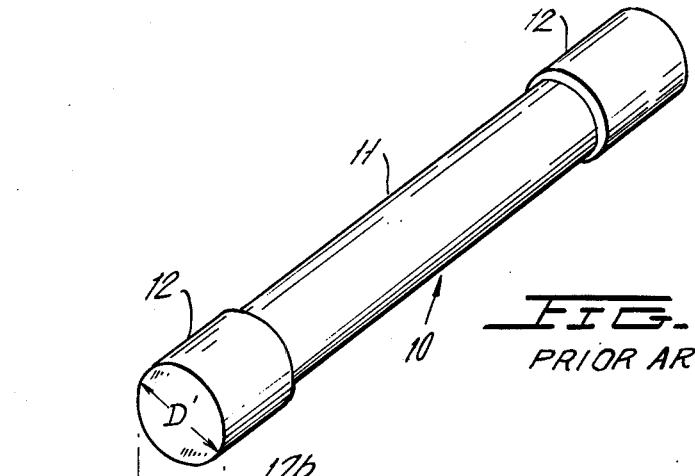
FIG. 1. PRIOR ART
FIG. 1 is a perspective view of a conventional ferrule terminal fuse clip and of a cartridge fuse having non-grooved ferrule end terminals for use with the conventional fuse clip.

Referring now to FIG. 1, conventional cartridge fuse 10 includes a hollow cylindrical body 11 of insulating material enclosing a fusible element (not shown for purposes of simplicity), which fusible element is rated to interrupt a relatively high current. A pair of smooth cylindrical ferrule end terminals 12 enclose the opposed ends of body 11 and provide an electrical terminal for each end of the fusible element therein.

A conventional ferrule terminal clip 15 includes a web portion 16 adapted for mounting to a flat surface and a pair of contact legs 17 and 18 extending in the same direction from opposite ends of web 16. Intermediate curved portions **17*a* and 18*a* of contact legs 17 and 18, respectively, have a radius of curvature corresponding to the radius of curvature of ferrule fuse terminal 12. The free end of each contact leg 17 and 18 includes a flange portion 17*b* and 18*b*, respectively, each diverging from the other and extending in a direction away from web 16. A reinforcing spring 19 is maintained in slots 20 in each contact arm to resiliently contact an exterior surface of each curved portion 17*a* and 18*a*. Reinforcing spring 19 increases the natural resilience of the metallic conductive material, such as copper or the like, forming terminal clip 15 to more strongly compress contact legs 17 and 18 towards each other to narrow the gap 22** formed therebetween.

In use, a second fuse terminal clip (not shown) is provided at a distance from terminal clip 15 selected to allow fuse 10 to be pressed downwardly with each ferrule end terminal 12 positioned between upwardly diverging flanges **17*b*, 18*b* of one of the fuse terminal clips. Upon application of a force directed toward web 16, contact legs 17 and 18 resiliently separate to allow each fuse terminal 12 to enter through gap 22 and be resiliently contacted by opposed curved portions 17*a* and 18*a***, respectively.

Figure 2:
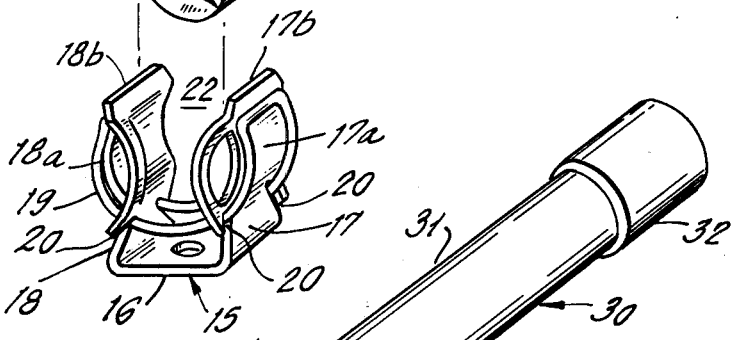
FIG. 2 is a perspective view of a ferrule fuse terminal clip having a pivoted rejector in accordance with the principles of the present invention and of a cartridge fuse having a grooved ferrule end terminal for insertion therein.
Figure 3:
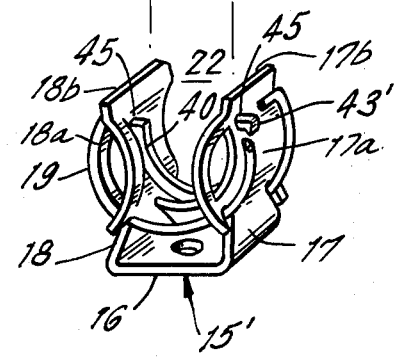
FIG. 3 is an oblique view of a pivotable rejector member as utilized in the ferrule fuse terminal clip of FIG. 2 in accordance with the principles of the present invention.
Figure 3:
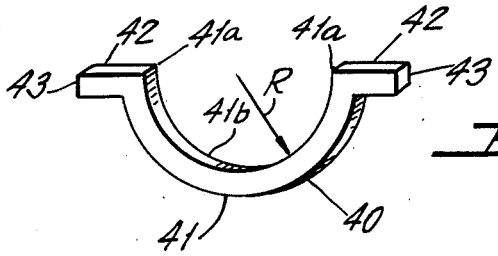

Referring now to FIG. 2, another cartridge fuse 30 includes a hollow cylindrical body 31 of insulating material enclosing another fusible element (not shown for purposes of simplicity), which fusible element is rated to interrupt a flow of current less than the minimum interruption current rating of cartridge fuse 10 of FIG. 1. The opposed ends of body 31 are enclosed by a pair of ferrule end terminals 32 and 33, respectively, to provide an electrical terminal for each end of the fusible element therein. Each ferrule end terminal has a smooth cylindrical exterior surface, with one end terminal 33 being formed with an annular groove 34 recessed into the exterior surface thereof.

Either cartridge fuse 10 or 30 can be resiliently mounted between the complementary curved portions 17*a* and 18*a* of the conventional ferrule terminal clip 15 (FIG. 1). The possibility of interchanging a low rated-current fuse 30 with a higher rated-current fuse 10 is acceptable in a circuit rated for a continuous current at least as high as the rating of fuse 10; the reduced current carrying capability provided by the lower rating of fuse 30 may more adequately protect a load device without a possibility of creating a heating hazard in the high rated-current circuit. Conversely, in a circuit having a maximum safe current rating greater than the maximum interruption rating of the class of fuse represented by fuse 30, but less than the maximum interruption current of the fuse represented by fuse 10, use of fuse terminal clip 15 allows the lower rated-current fuse 30 to be replaced by the higher rated-current fuse 10 to allow passage of a fault current greater than the maximum safe value to create a hazard therein.

I have found that a terminal clip 15′ having a rejector member 40 will prevent installation of a high current rating cartridge fuse 10 while facilitating the insertion of a grooved terminal 33 of a low current rating cartridge fuse 30. The rejector member 40 includes a U-shaped central portion 41 having a radius of curvature R substantially equal to one-half the diameter D of recessed groove 34 in the grooved ferrule end terminal 33 of low current fuse 30, but less than ½ the diameter D′ of the non-grooved ferrule end terminal 12 of high current rating cartridge fuse 10. A pivot arm 42 extends outwardly from each free end 41*a* of U-shaped portion 41. Rejector member 40 may be stamped from a sheet of a suitable material, such as steel or the like, having a thickness sufficient to form each pivot arm 42 with a substantially square cross-section.

A circular aperture 45 is formed in each control leg 17, 18 with the axes of apertures 45 in alignment and substantially parallel to the plane of web 16.

Rejector member 40 is installed in fuse terminal clip 15′ by expanding contact legs 17 and 18 thereof to allow each contact arm 42 to enter through one of the aligned apertures 45. Contact legs 17 and 18 are released to resiliently return to their original positions. The outer end 43 of each pivot arm 42 is peened over at 43′ to prevent its removal through an associated aperture 45. The diameter of each aperture 45 is slightly larger than the greatest diagonal distance through each pivot arm 42 to allow for rotation of each pivot arm in its associated aperture 45 and hence pivoting of U-shaped portion 41 about the axes of its pivot arms 42.

Upon installation of low current rating fuse 30 in rejector fuse clip 15′, grooved end terminal 33 enters the gap 22 between contact leg 17 and 18 with the exterior surface of the groove portion 34 in contact with the interior surface 41*b* of U-shaped portion 41 of rejector member 40. In the event that a non-grooved end terminal 12 of a high current rating cartridge fuse 10 is attemped to be inserted between contact legs 17 and 18 of rejector-type terminal clip 15′, the end terminal 12 cannot pass between free ends 41*a*, 41*a* and is rejected by clip 15′. Thus, only a cartridge fuse 30 having an end terminal 33 with recessed groove 34 may be fully seated within rejector-type fuse terminal clip 15′. The insertion and removal of the grooved fuse terminal is facilitated by the pivoting motion of rejector member 40 about its pivot arm 42 freely rotatable in its aligned apertures 45.

There has just been described a novel ferrule fuse terminal clip having a pivoted rejector member facilitating insertion of a grooved ferrule end terminal in the clip while causing the rejection of a non-grooved ferrule end terminal; the rejector member cannot be removed with commonly available tools without rendering the fuse terminal clip unusable.

The present invention has been described with reference to a preferred embodiment thereof; many modifications and variations will now be apparent to those skilled in the art. Therefore, this invention is not to be limited by the specific disclosure herein, but only by the scope of the claims appended hereto.

What is claimed is:

1. A fuse terminal clip forming an electrical connection to fuse means including a cylindrical ferrule end terminal having an annular groove recessed therein, said fuse terminal clip comprising:

space means including a pair of spaced contact legs for electrically contacting opposed portions of said terminal, said spaced contacting means adapted to resiliently capture said terminal between said contact legs;

a generally U-shaped rejection member supported on and extending between said spaced contact legs, and cooperating with said groove for rejecting a ferrule end terminal lacking said groove and for facilitating insertion and capture between said spaced means only of a fuse means having a ferrule end terminal provided with said groove means; said rejection member comprising a single stamping from sheet material and including arms spaced by a distance greater than the diameter of said annular groove and less than the diameter of said cylindrical ferrule end terminal; said rejection member also including a pair of aligned pivot arms extending in opposite directions from said arms through aligned apertures in said contact legs whereby said contact legs support said pivot arms for tilting of said rejection member; and said pivot arms having their ends outboard of said contact legs peened over to provide the sole means for preventing the removal of said rejection member from said spaced contacting means.

2. A fuse terminal clip as set forth in claim 1, further comprising means for increasing the resilience of said spaced means to increase the electrical conductivity between said spaced means and said ferrule end terminal captured between said contact legs.

3. A fuse terminal clip as set forth in claim 1, wherein said spaced means also includes a web positioned substantially parallel to said aligned pivot arms; said pair of contact legs extending in the same direction from respective opposite ends of said web and having concave surfaces facing each other.

4. A fuse terminal clip as set forth in claim 1, wherein said rejection member has a radius of curvature substantially equal to the radius of curvature of said annular groove and less than a radius of curvature of said cylindrical ferrule end terminal.

* * * * *